United States Patent [19]

Martin

[11] Patent Number: 4,940,235

[45] Date of Patent: Jul. 10, 1990

[54] METHOD FOR PLAYING A BOARD GAME

[76] Inventor: Linda Martin, 1926 83rd Ave., Oakland, Calif. 94612

[21] Appl. No.: 385,802

[22] Filed: Jul. 26, 1989

[51] Int. Cl.[5] ..... A63F 3/00

[52] U.S. Cl. ..... 273/236; 273/243; 273/264

[58] Field of Search ..... 273/236, 269, 271, 264, 273/272, 274, 276, 242, 246, 243

[56] References Cited

U.S. PATENT DOCUMENTS 682,388 9/1901 Pigueron ..... 273/271
3,111,320 11/1963 Acosta ..... 273/264

FOREIGN PATENT DOCUMENTS 889725 2/1962 United Kingdom ..... 273/246

*Primary Examiner*—Benjamin Layno
*Attorney, Agent, or Firm*—Limbach, Limbach & Sutton

[57] ABSTRACT

A game board (10) having nine regions (12, 14, 16, 18, 20, 22, 24, 26, 28) and four penalty regions (30, 32, 34, 36) is played using a pair of standard, six sided dice (42), a plurality of instruction cards (40), and a plurality of game pieces (38). Each game player has a set of game pieces (38) which are the same shape and/or color. Seven of the nine regions are defined as playing regions (12, 14, 16, 18, 20, 22, 24) and have numbers associated with each, one region (28) is where the instruction cards (40) are placed and selected from and also has a unique number associated with it, and one region (26) is where a new game piece enters the board. Each instruction card (40) has an instruction relating to the movement of a game piece (38) on the board (10).

2 Claims, 4 Drawing Sheets

METHOD FOR PLAYING A BOARD GAME

TECHNICAL FIELD

The present invention broadly relates to a method of playing board games and more particularly it relates to a board game having a unique numbering system and a plurality of locations on the board where game pieces are moved to and from the board based upon the roll of the dice.

BACKGROUND ART

Educational and recreational board games, where markers are moved around a board based upon the roll of the dice, are well known. Usually, the dice are thrown, and either written instructions or instructions printed in the playing fields of the board instruct where a game piece is to placed.

SUMMARY OF THE INVENTION

The present invention provides a method of playing a board game with a plurality of players. The game is played with a plurality of instruction cards bearing instructions; a game board having a plurality of playing regions, each having a preselected number associated with it, and each of the playing regions further having a preselected number of boxes; at least one die having a number on each of its faces; and a plurality of game board pieces wherein the game board pieces are selectively apportioned among the players. The game board has a card region having at least one unique number associated with it, at least one penalty region, and an enter region. Each of the players rolls the dice and assesses the number rolled. A new game piece is introduced onto the board, in the enter region, if the number on the die is a first number. Next, the player determines the total rolled based upon the number rolled if a single die is used, or if a plurality of die are used, by totalling the numbers rolled, provided the number rolled is other than the first number. The game players select an instruction card if the total is the unique number associated with the card region. The player carries out the instruction according to the selected card. If the total is a number other than the unique number, a game piece is moved from the enter region to one of the boxes in the playing region corresponding to the total rolled. It is therefore a primary object of the present invention to provide a method for playing a game board wherein instruction cards are selected if a first number is rolled, games pieces are entered onto the game board if certain numbers are rolled, or game pieces are moved to selected regions on the game board if preselected other numbers are rolled.

Another object of the invention is to provide a game board where pieces are moved on and off the board by answering a trivia question.

These, and further objects and advantages of the present invention will be made clear or will become apparent during the course of the following description of the preferred embodiment of the present invention.

DETAILED DESCRIPTION OF THE PREFERRED EMBODIMENT AND THE PLAY OF THE GAME

Figure 1:
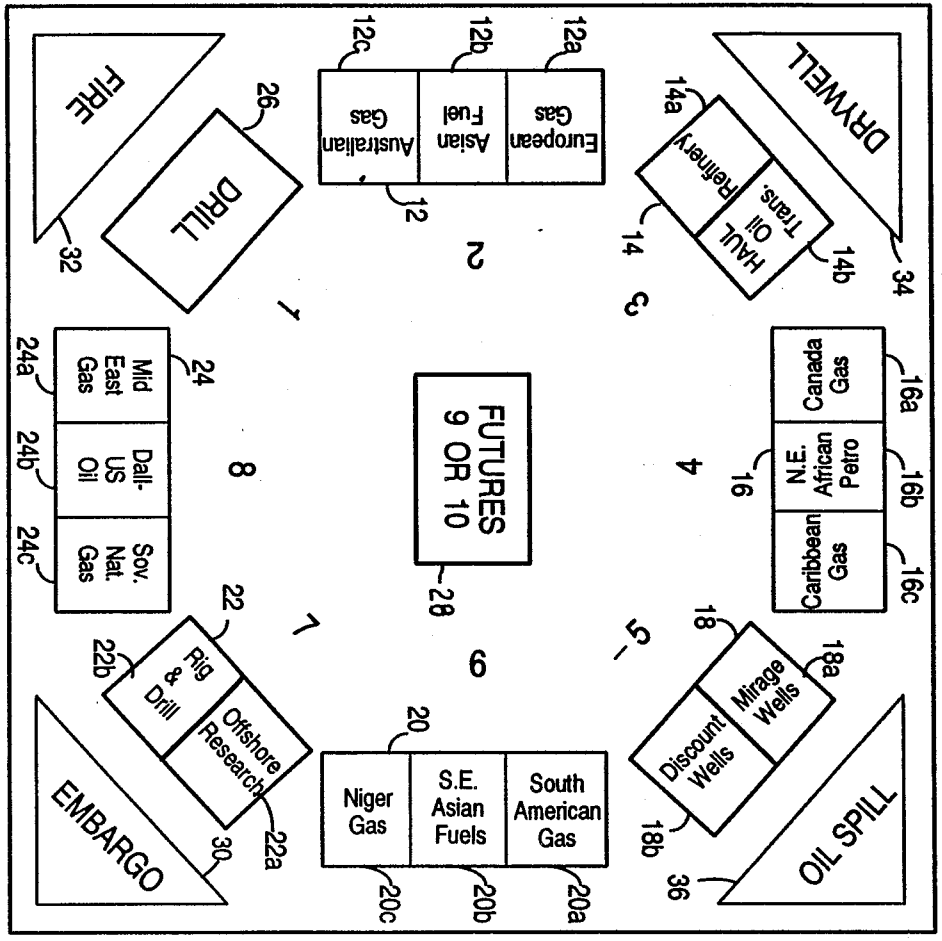
FIG. 1 is a top view of the game board of the present invention.
Figures 3A, 3B:
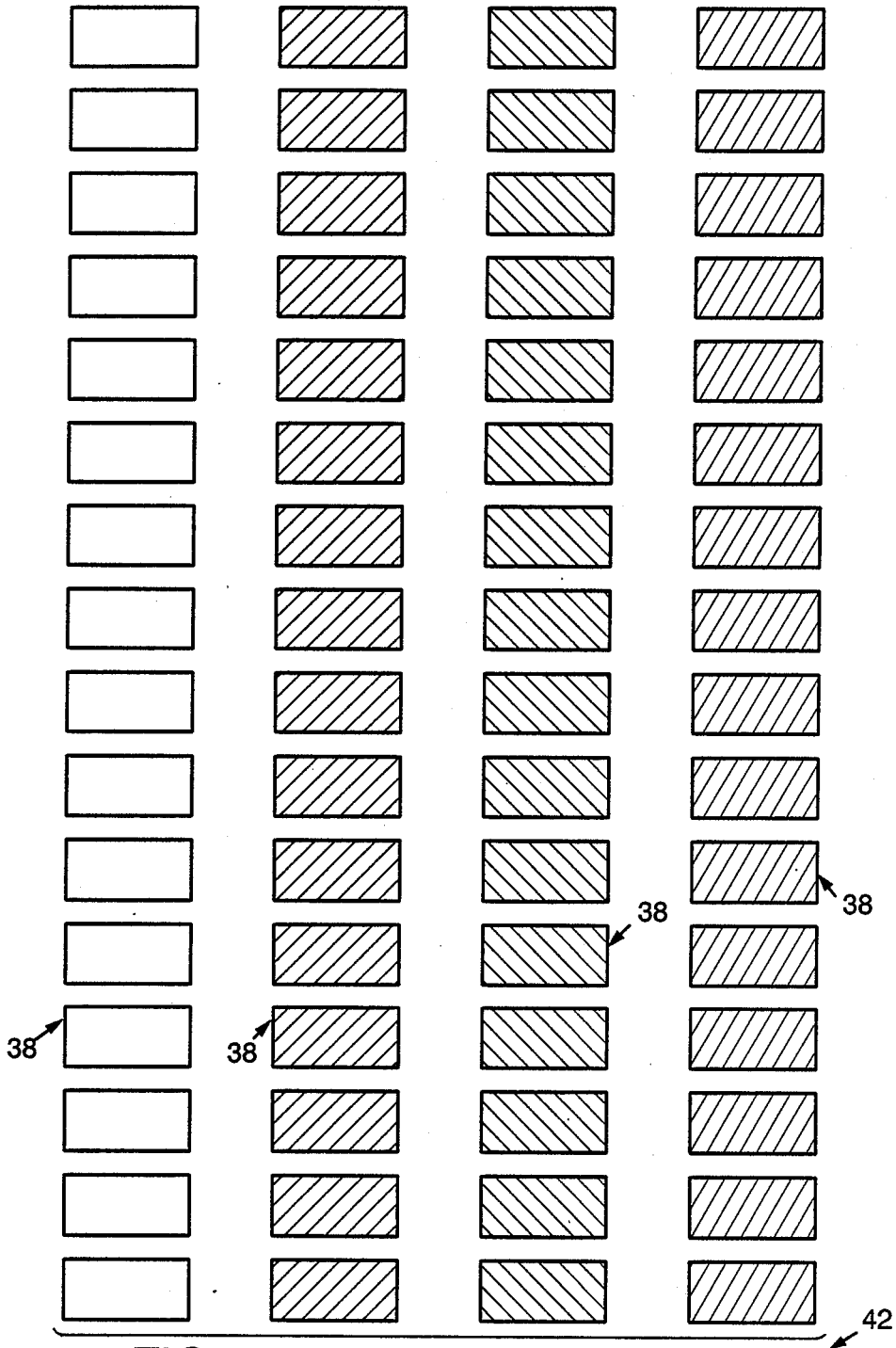
FIG. 3*a* is a perspective view of the game pieces and FIG. 3*b* is a perspective view of dice used in the present invention.

Referring to FIG. 1, a game board 10 having nine regions 12, 14, 16, 18, 20, 22, 24, 26, 28 is illustrated. The game board 10 may be on any shape and size. In the preferred embodiment it is square-shaped. Each of the four corners of the board 10 is designated as a penalty region 30, 32, 34, 36. The penalty regions 30, 32, 24, 36 are each given a name based upon the subject matter or theme of the game. In the preferred embodiment, the theme of the game is petroleum and the oil industry. As such, the names of the penalty regions are "Fire" 32, "Dry Well" 34, "Oil Spill" 36, and "Embargo" 30. A pair of standard, six, sided dice 42 (FIG. 3*b*), having numbers 1–6 respectively on each face, are used when playing the game to move game pieces 38 (FIG. 3*a*) around the board 10 and to select instruction cards 40.

Seven of the regions 12, 14, 16, 18, 20, 22, 24 are defined as playing regions and they are arranged in an octagonal pattern around the perimeter of the board. Each playing region 12, 14, 16, 18, 20, 22, 24 is assigned a number ranging from 2–8 (the number may be positive or negative) which, as will be discussed below, also corresponds to the point value for that region. Each of the seven playing regions 12, 14, 16, 18, 20, 22, 24 is also given a name or has an illustration associated with it. Region 28 is located in the center of the board 10 and numbers 9 and 10 are associated with it. Region 28 is called the "Futures" region and is where the instruction cards are placed. Another region 26, entitled "Drill", is the region where the game pieces 38 enter the game board 10 when either the number 6 or 6&6 are rolled and appear on the face of one or both of the dice 42, respectively. Hence the number six is used in the game as the primary way in which new game pieces 28 are introduced onto the board 10.

In the preferred embodiment, the game can be played with up to four different players or teams of players. Each player is supplied with sixteen identical game pieces 38 (FIG. 3*a*) which are the same color and/or shape. In the preferred embodiment the pieces 38 are all rectangular but are different colors: red, green, blue, and yellow. There are sixty four pieces 38 in total, sixteen of each color. Before beginning the game, the set of instruction cards 40 (FIG. 2) are placed in the center of the board 10 on the Futures region 38.

Figure 2:
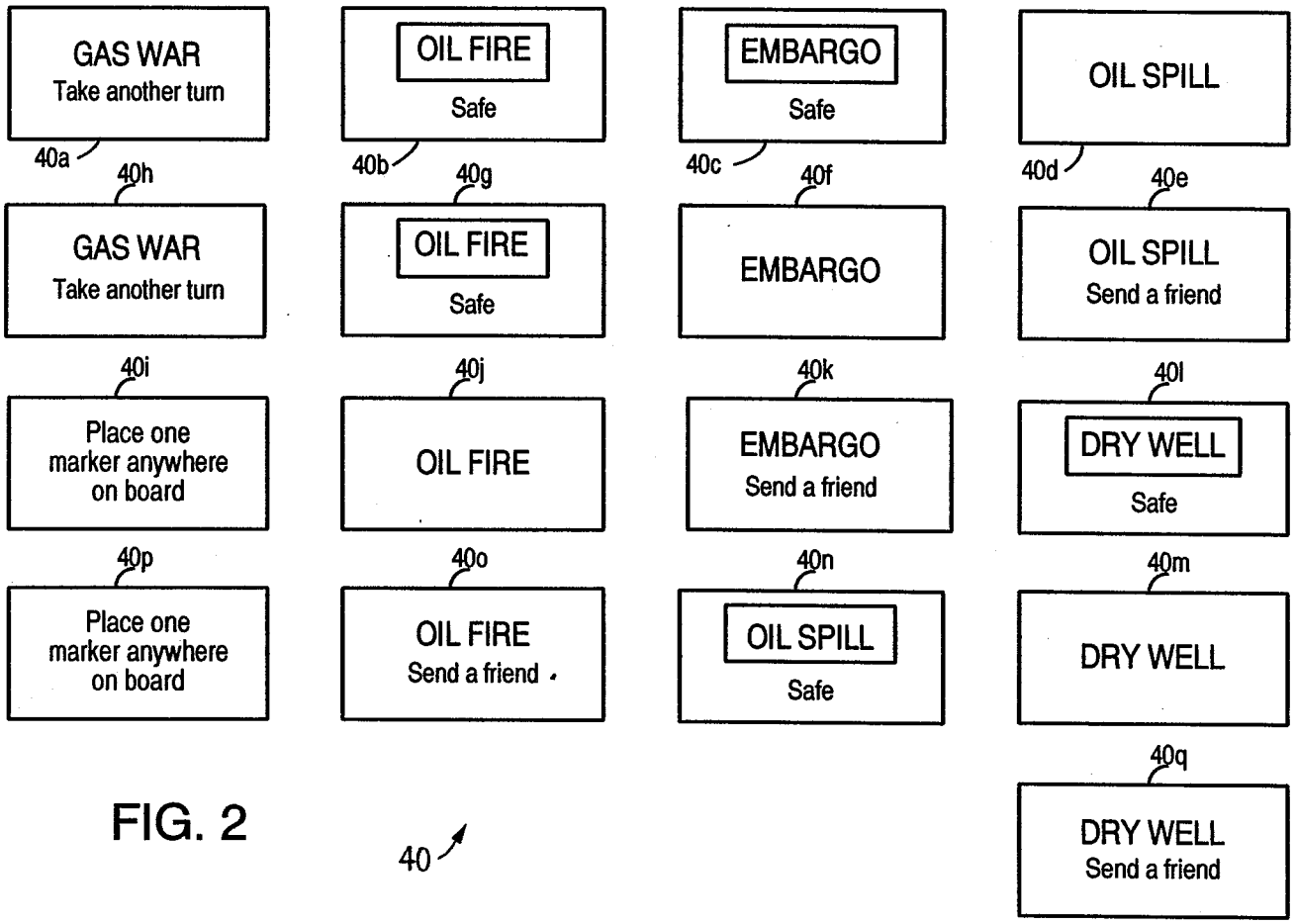
FIG. 2 is a top view of representative instruction cards used in the present invention.

Referring also to FIG. 2, the game has a plurality of instruction cards generally referred to as 40. In the preferred embodiment, some of the instructions on the cards 40*a*–40*g*, 40*j*–40*o*, 40*q* relate to one of the penalty regions 30, 32, 34, 36, while other cards 40*i*, 40*p* allow the player to introduce a new game piece 38 onto the board 10, and still other cards 40*a*, 40*h* permit the player who selected the card to take another turn.

PLAYING THE GAME

As previously discussed, the game pieces 38 enter the game board 10 on the Drill region 26. At the commencement of the game, each player places two game pieces 38 on Drill 26. The players decide amongst themselves their playing order. When it is a players turn, the player rolls the dice 42. If one six is rolled, the player introduces a new game piece 38 on Drill 26; if two sixes are rolled, two markers are placed on Drill 26. If no sixes are not rolled, the player adds up the numbers on the face of the dice 42.

If the dice total, excluding a rolled six, adds up to range from 2 to 8, the player moves one of his pieces 38 from Drill 26 to the numbered playing region corresponding to the dice total (i.e., numbers 2–8). The totals eleven or twelve are not values in the game since a six is not totaled with another number. Again, a rolled six has been designated to only be used to enter new pieces 38 onto the game board 10.

If the total equals nine or ten, an instruction card 40 is taken from the "Futures" region 22 and the instruction on the card 40 is carried out. For example, for a card 40 labelled "Oil Fire," "Dry Well," "Oil Spill," or "Embargo," the player removes one of his pieces 38 from any playing region 12, 14, 16, 18, 20, 22, 24 on the board 10 and places it in the penalty region 30, 32, 34, 36, corresponding to the label on the card 40. If the instruction card 40 has the word "safe" on it, it enables the player to remove a pair of game pieces 38 from the penalty region named on the "safe" card. The "safe" card may be saved and used later in the game.

If the instruction card 40 selected reads "Place marker anywhere", the player is permitted to introduce a new game piece 38 onto the board 10 and it may be placed anywhere on the board 10. If the instruction card 40 instructs the player to "Send a friend", the player directs one of the other players to place one of its marker in one of the four penalty regions 30, 32, 34, 36. Once a Futures card has been used, it is placed on the bottom of the Future's card stack.

Figure 4:
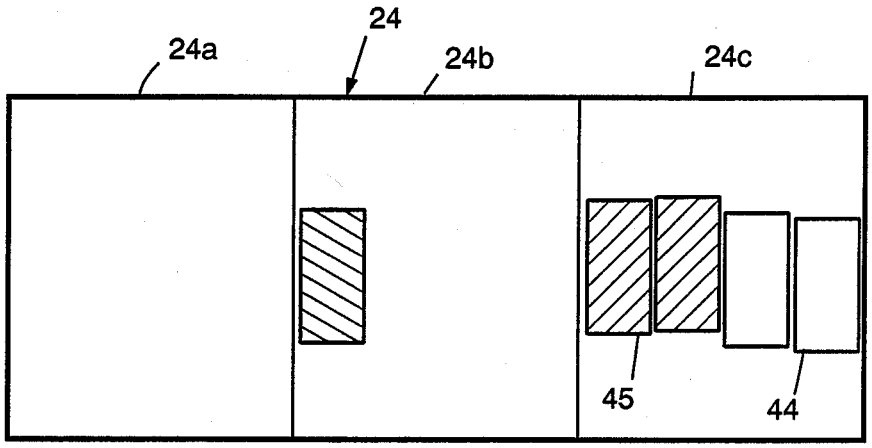
FIG. 4 is a top view of a portion of the game board of FIG. 1 illustrating a pair of markers in one of three adjoining boxes on the game board.
Figure 5:
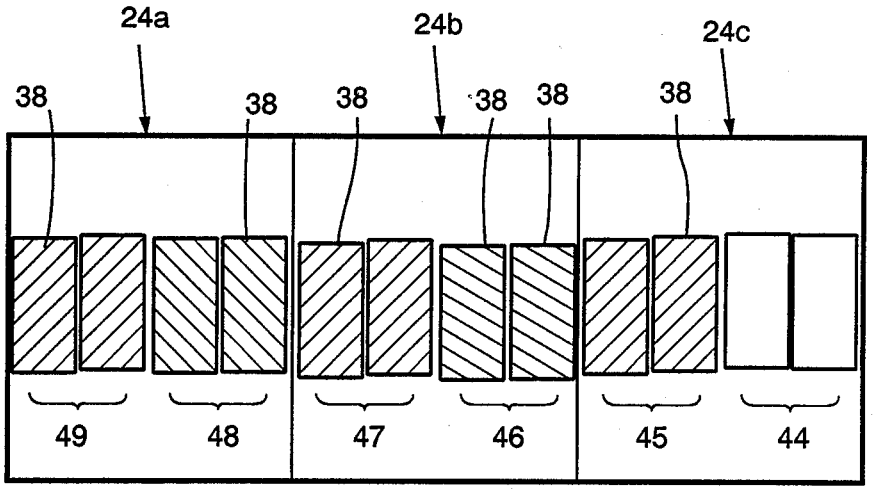
FIG. 5 is a top view similar to FIG. 4 of a portion of the game board illustrating matched pairs in adjoining boxes.

Referring to FIGS. 1, 4 and 5 concurrently, the playing regions 12, 14, 16, 18, 20, 22, 24 are subdivided into playing boxes. As illustrated, the playing regions 12, 14, 16, 18, 20, 22, 24 are alternately subdivided into either two boxes **14*a*, 14*b*, 18*a*, 18*b*, 22*a*, 22*b* (respectively corresponding to playing regions 14, 18, 22) or three boxes 12*a*, 12*b*, 12*c*, 16*a*, 16*b*, 16*c*, 20*a*, 20*b*, 20*c*, 24*a*, 24*b*, 24*c* (respectively corresponding to playing regions 12, 16, 20, 24). All players may place game pieces 38 in a box until the box becomes filled with two pairs 44, 45 of identical game pieces 38. Referring to FIG. 4 in particular, for example, when one box 24*c* in a playing region 24 becomes filled with two pairs 44, 45 of game pieces 38, the remaining unpaired pieces 38 are moved into an available box 24*a*, 24*b* within the same particular playing region 24. Referring to FIG. 5, when all of the boxes 24*a*, 24*b*, 24*c* are filled (i.e., each box in a playing region has two pairs of markers 44 and 45, 46 and 47, 48 and 49), any remaining single pieces 38 are moved back to the Drill region 26**.

If a player runs out of game pieces 38 in the Drill region 26, he may move one of his pieces 38 currently in a box back to drill 26 and also introduce two new game pieces 38 onto the board 10 or he may decline to take any action after throwing the dice 42 (i.e., the current player "passes" to the next player).

As previously discussed, the numbers 2–8, associated with each of the seven playing regions 12, 14, 16, 18, 20, 22, 24, are the points that each player is awarded for each of his matched pairs 44, 45 in the box. The first player to reach 30 points wins or, the first player who gets one pair of game pieces on any three adjoining boxes in region 12, 16, 20, or 24, as illustrated in FIG. 5, wins the game. The playing region designated with the number −5 (region 18) means that for each pair in box **18*a* or 18*b*, five points is deducted from the player's final score. For each matched pair in a penalty region 30, 32, 34, 36**, one point is deducted from the player's final score.

The game may be modified by, for example, by playing in teams, increasing the number of points needed to win, placing markers on the board when another number aside from a six is rolled, by obtaining the points associated with the playing region when a matched pair is obtained and by answering a trivia question associated with subject matter of the box, or by only being able to move a game piece into a box by answering a trivia question about the box.

Having thus described the invention, it is recognized that those skilled in the art may make various modifications or additions to the preferred embodiment chosen to illustrate the invention without departing from the spirit and scope of the present contribution to the art. Accordingly, it is to be understood that the prosecution sought and to be afforded hereby should be deemed to extend to the subject matter claimed and all equivalents thereof within the scope of the invention.

What is claimed is:

1. A method of playing a board game with at least one die having a number on each of its faces by a plurality of players comprising the following steps:

providing a plurality of game board pieces;

selectively apportioning the game board pieces among the players whereby each player is apportioned selective game pieces;

providing a plurality of instruction cards bearing instructions;

providing a game board having a plurality of playing regions each having one of a plurality of preselected numbers corresponding to the numbers selected with the rolling of at least one die, each of the playing regions further comprising a preselected number of boxes, a card region having at least one unique number corresponding to a number selected with rolling at least one die wherein the unique number differs from the preselected plurality of numbers and the instruction cards are located in the card region, at least one penalty region, and an enter region;

rolling the die and assessing the number rolled;

introducing a new game piece onto the board in the enter region if the number on the die is a first number;

determining a total based upon the number rolled if a single die is used or if a plurality of die are used by totaling the numbers rolled if the number rolled is other than the first number;

selecting an instruction card if the total number is the unique number and carrying out the instruction on the selected card; and moving a game piece from the enter region to one of the boxes in the playing region having the preselected number corresponding to the total number rolled when the total is other than the unique number.

2. A method of playing a board game by a plurality of players and two dice each having a number on each of its faces, comprising the steps of:

providing a plurality of game board pieces;

selectively apportioning the game board pieces amongst the players whereby each player is apportioned selective game pieces and the game pieces apportioned to each player is distinguishable from the game pieces apportioned to the other players;

providing a plurality of instruction cards bearing instructions;

providing a game board having a plurality of playing regions each having one of a plurality of unique numbers ranging from 2 to 8 corresponding to numbers selected with rolling said dice and each of the playing regions further comprising a preselected number of boxes, a card region having the numbers 9 and 10 corresponding to numbers selected with rolling the dice and the instruction cards are located in the card region, at least one penalty region, and an enter region;

rolling the dice and assessing the number rolled;

introducing a new game piece onto the board in the enter region for each of the die rolled whose number is six;

determining an added number by adding the rolled numbers on each of the die together for rolled numbers other than a six;

selecting an instruction card if the added number is a 9 or 10 and carrying out the instruction on the selected card; and moving a game piece from the enter region to one of the boxes in the playing region having the unique number corresponding to the added number when the added number is between 2 and 8.

* * * * *